United States Patent [19]

Tolkiehn et al.

[11] 4,262,621

[45] Apr. 21, 1981

[54] REMOTE-CONTROLLED SUBMERSIBLE DROGUE

[75] Inventors: Ulrich Tolkiehn; Uwe Wüstefeld, both of Hamburg, Fed. Rep. of Germany

[73] Assignee: Gernot Dittberner, Hamburg, Fed. Rep. of Germany

[21] Appl. No.: 770,427

[22] Filed: Feb. 22, 1977

[51] Int. Cl.[3] ..... B63B 21/00

[52] U.S. Cl. ..... 114/245; 114/332

[58] Field of Search ..... 114/242, 244, 245, 246, 114/253, 247, 312, 322, 330, 331, 332; 340/3 T; 244/153.5, 36; 273/359, 360

[56] References Cited

U.S. PATENT DOCUMENTS

| | | | |
|---|---|---|---|
| 2,898,058 | 8/1959 | Del Mar | 244/3 |
| 2,997,689 | 8/1961 | Johnson et al. | 340/3 T |
| 3,034,468 | 5/1962 | Aschinger | 114/244 |
| 3,688,730 | 9/1972 | Ortlieb et al. | 114/331 |
| 3,760,761 | 9/1973 | Umazume | 114/244 |
| 3,918,663 | 11/1975 | Cornelison, Jr. | 244/153 R |
| 3,978,811 | 9/1976 | Angus et al. | 340/3 T |

*Primary Examiner*—Trygve M. Blix
*Assistant Examiner*—D. W. Keen
*Attorney, Agent, or Firm*—Thomas E. Beall, Jr.

[57] ABSTRACT

The invention concerns a remote-controlled submersible drogue of the type used for carrying probes for marine research. The drogue is connected by a towrope or cable to a towing craft and comprises a lifting body which has a cross sectional shape which is dynamically stabilizing. In addition, the drogue includes a static stabilizer comprising a flat plate extending downwardly and rearwardly from the lifting body and the towrope is arranged to be attached at the tip of the front end of the drogue.

7 Claims, 4 Drawing Figures

REMOTE-CONTROLLED SUBMERSIBLE DROGUE

BACKGROUND OF THE INVENTION

The invention refers to a remote controlled submersible drogue forming a probe-carrier, in particular for marine research under water, which is connected by means of a towrope or probe cable to a towing craft and comprises a lifting body which exhibits a longitudinal profile which generates a dynamic lift, a static stabilizer arranged in the lifting body, an adjustable elevator and also a towrope attachment.

In a known drogue of this kind (see U.S. Pat. No. 3,688,730) the towrope attachment is provided by means of a "balance", i.e., the rope is attached by means of a forked stirrup to two hingepins protruding sideways out of the lifting body. This kind of attachment of the towrope, as is both easily demonstrated in theory and also has been proved by practical tests, prevents any self-stabilizing of the transverse axis of the drogue. The stirrup holds the transverse axis of the drogue always perpendicular to the direction of the end of the rope. Even with very perfect symmetrical alignment of the drogue and the stirrup and with oscillation-free straight-ahead running of the drogue a trifling alteration off-course of the towing vessel and hence an alteration of the direction of the rope is enough to tilt the initial desired and achieved horizontal position of the transverse axis of the drogue which runs through the two hingepins, and thereby induce motion of the drogue along an arc of a circle the centre of which lies in the effective direction of the rope, up to the surface of the water. This circular motion, depending upon the length of rope and depth of immersion, leads to surfacing of the drogue sideways from the original path of tow 90°, or further listing or to motion of the drogue on a spiral path. Again, the lifting body of the known device exhibits an essentially elliptical cross-section which as regards transverse stabilization with the towed body set at an angle is of equally little advantage, since because of the convex superficial shape of the ellipse and a backwater curve shifting arbitrarily with differing angle of incident flow the pressure ratios on the surface of the lifting body are such that a list is increased rather than its coming to a restoration of the desired aligned position. Finally the stabilizer in the case of the known applicance extends over only part of the length of the lifting body and has the shape of an aerofoil profile.

The static stabilizing effect which is striven for by this is relatively slight when measured against the great technical and structural outlay upon the aerofoil profile. Furthermore the latter prevents simple fitting of any kind of measuring probe or the pressure housing necessary for it, so that for this purpose the lifting body must be employed.

Another known drogue (see West German OS No. 22 07 880) consists of a Zepplin like stream-lined hull, lifting surfaces and a vertical fin which are combined together into one structural unit. At the rear edge of the lifting surfaces combined elevator-ailerons are arranged, whilst in the end region of the vertical fin a rudder is arranged. The towing and supply cable is hinged-on near to the dynamic centre of the hull. This drogue has indeed at adequate speed an adequate degree of floatation stability, but the static stability is inadequate. Also it has no adequate stability against turning, i.e., listing or "spinning". once a certain sideways tilt is reached. By the attachment of the cable near to the dynamic centre of gravity of the drogue the deficient static and dynamic stability is only partially compensated, but free deflectability of the cable is not possible. In order to be able to sink the drogue to greater depths it is necessary to let out a greater length of cable from the towing craft.

SUMMARY OF THE INVENTION

According to the invention these problems may be solved by a drogue of this, general type in which the lifting body has a dynamically stabilizing cross-sectional shape, the static stabilizer comprises a flat plate extending downwardly and rearwardly from the fitting body, and the towrope attachment is arranged at the tip of the front end of the drogue.

Thus, without auxiliary devices such as ailerons and/or rudder the drogue can retain at any controlled depth a stable horizontal position of the transverse axis, in which case a tow can be effected at different depths without alteration of the length of rope and of the speed of tow and the drogue can have a high degree of freedom of movement with respect to the towrope.

Preferably, the lifting body exhibits a dynamically stabilizing cross-sectional shape after the style of a box kite, preferably a rhombus.

By "cross-sectional shape after the style of a box kite" a shape of profile is to be understood which serves to generate vertical dynamic forces. Naturally by that is meant only the outside contour, since the lifting body in contrast to an actual box kite is not open right through. Because of the box kite shape the lifting body can be deflected to one side but it then stays stable because the crest line with the incident flow in the water forms between the two upper and the two lower surfaces, which in each case are the same size, a watershed. These surfaces are inclined to one another at a definite angle. The stabilizing action can be explained as follows:

If the flow acts on top of the lifting body the dynamic pressure is distributed uniformly on the left and right halves of the surface, inasmuch as the transverse axis is lying horizontally. If it is now, for example, sloped down to the left the lefthand half of the surface becomes "steeper", whilst the righthand half is opposed to the relative flow and the flow against it becomes steeper. The consequence is a higher dynamic pressure on the righthand half, so that the transverse axis is thereby turned back into its original position. Thus if the transverse axis in its original position is lying horizontal, which is guaranteed by the static stabilization as a result of the arrangement of the plate, it is clear that the shape of profile of the lifting body stabilizes the drogue with regard to the transverse axis, that is, independently of the direction and speed of the relative flow, provided that the device is not impeded by unforseen circumstances such, e.g., as damage, mechanical obstacles or the like from turning back into the original position.

The static stability is guaranteed by a design of the drogue which is generally T-shaped in cross-section, that is, in particular by the arrangement of the plated on the lifting body. As is well known the dynamic forces in the kite are directed exclusively vertically upwards and downwards and lateral components which happened to arise would lead to a line of path of the drogue running in the shape of a spiral and to destruction of the towing and probe cable. Whilst in the case of submarines by, e.g., the arrangement of the centre of buoyancy above the centre of gravity a static righting moment is brought about, or in the case of aircraft the dynamic transverse stabilization is brought about by means of ailerons and in the case of probe craft by a combination of both or by an additional arrangement of rudders, these auxiliary means are in the case of the drogue of the invention superfluous because of the development of the kite shape as a floating body with the plate connected to it so that, as with submarines, the centre of buoyancy lies above the centre of gravity.

The attachment of the towrope to the tip of the drogue finally enables self-centering of the transverse axis of the drogue with listing occurring, i.e, in the case of deflection of the transverse axis out of its horizontal position whilst at the same time the drogue can be freely deflected upwards and downwards, whereby it can travel without difficulty at different depths of immersion and with very different positions of the towing cable independently of whether the cable is lying above or below the drogue.

The solution of the problem underlying the invention, namely, to provide a drogue which can be perfectly controlled and is stable in any position, is thus achieved by the spatial combination of the features described above, and the transverse stabilization of the body being dependent both upon the external box kite shape and upon the point of attachment of the towrope.

In order to arrange the centre of gravity as low as possible and thereby achieve a high static restoring moment the pressure housing or housings should preferably be fastened to the bottom part of the plate. The plate, in order to be able to accept these pressure housings, is provided with cutaways below the lifting body when seen in the longitudinal direction, in which case the pressure housing or housings for the probes lie between front and rear parts of the plate, whilst the two parts of the plate may be connected together by a keel tube, which in addition contributes to the centre of gravity being arranged as low as possible. But the righting moment because of the T-shape serves only to keep the transverse axis horizontal when there is no relative flow or the longitudinal axis is lying horizontal so that no dynamic lifting or downwards driving forces are effective on the kite surfaces.

In order, in spite of the hinging of the towrope onto the tip of the drogue, to be able to control it sufficiently easily, in accordance with a further preferred embodiment of the invention the lifting body should exhibit in outline a pear shape. In this way the dynamic centre of mass gets shifted as far as possible forward, which in combination with the preferred arrangement of the elevator as far as possible to the rear, i.e., at a distance from the lifting body, provides for advantageous ratios of moments. For by this arrangement of the elevator at the greatest possible distance from the dynamic centre of mass a particularly large positioning moment is obtained and hence favourable control possibilities, because the positioning moment represents the product of the control surface force from the elevator and the leverage between the latter and the dynamic centre of mass. This is equal to the opposing restoring moment formed of the large restoring force from the lifting surfaces of the lifting body engaging at the dynamic center of mass and the small leverage.

In order to achieve good damping of the motion from the swell transmitted from the towing craft to the towed body and to improve the mobility of the latter as compared with known devices, the length of the probe cable may correspond with approximately five times the maximum measuring depth. Thus it is in any case ensured that the main object of the invention can be fulfilled with ease, namely to set the drogue at any desired depth or to follow up a path at depth preset from the towing craft without the length of rope or the speed of tow needing to be altered.

Seen as a whole there is obtained by the invention a drogue which without additional auxiliary means such, i.e., as ailerons and/or rudder guarantees at all controlled depths a stable position of the transverse axis.

BRIEF DESCRIPTION OF THE DRAWING

One example of the invention is explained in greater detail below with the aid of the accompanying diagrammatic drawings, in which.

DETAILED DESCRIPTION

Figure 1:
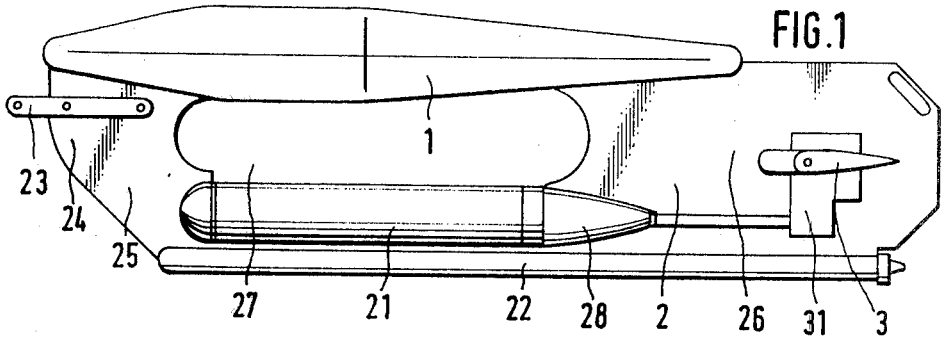
FIG. 1 is a side elevation of the towed body.
Figure 2:
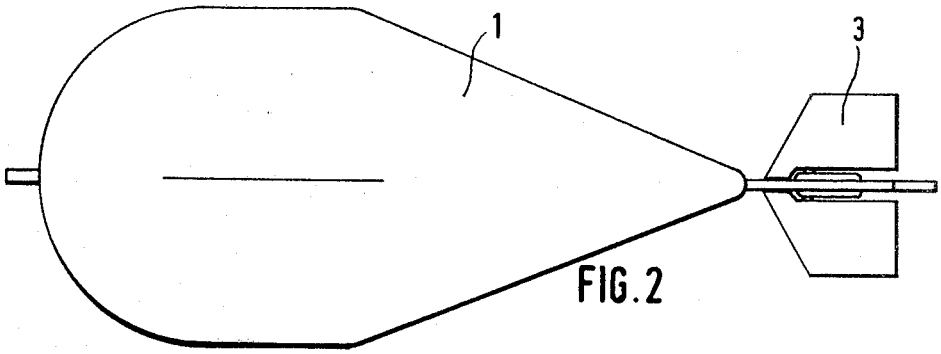
FIG. 2 is a plan view.

The drogue designed as a probe carrier comprises essentially a lifting-body 1, a plate 2 which extends downwards and backwards from it and is divided into a front part-plate 25 and a rear part-plate 26, at least one pressure housing 21 as receiver for the measuring probes, a keel tube 22 connecting the two part-plates 25 and 26, and an adjustable elevator 3 arranged in the rear part of the plate 2 at a distance from the lifting body 1. At the front end 24 of the front part-plate 25 is a towrope attachment 23 for a towrope and/or probe cable 4.

It will be observed that between the part-plates 25 and 26, cutaways 27 are provided in order to accept one or more pressure housing 21. If only one pressure housing 21 is necessary for measuring probes, this will be provided for at the lowest cutaway 27 in order to provide for the centre of gravity being as low as possible with respect to the centre of buoyancy or volume which as a result of the lifting body 1 lies relatively high up, so that a righting moment as large as possible is guaranteed.

In the pressure housing 21 there are, for example, measuring probes as well as an emitter, and electronic control equipment, for a motor arranged at the rear end of the pressure housing and covered by a cladding 28, for operating the elevator 3. This elevator is actuated by the motor via an elevator mechanism 31 of which, however, can be seen here only the covering housing.

The elevator 3, in relation to the lifting body 1 which is rhombial in cross-section and pear-shaped in outline, is seated far to the rear of the towed body, whereby good conditions result for the setting moment and hence above all for the up and down controllability of the drogue. In other words small twists of the elevator 3 alone are enough for the device to reach another measuring depth without the rope length having to be altered.

Figure 4:
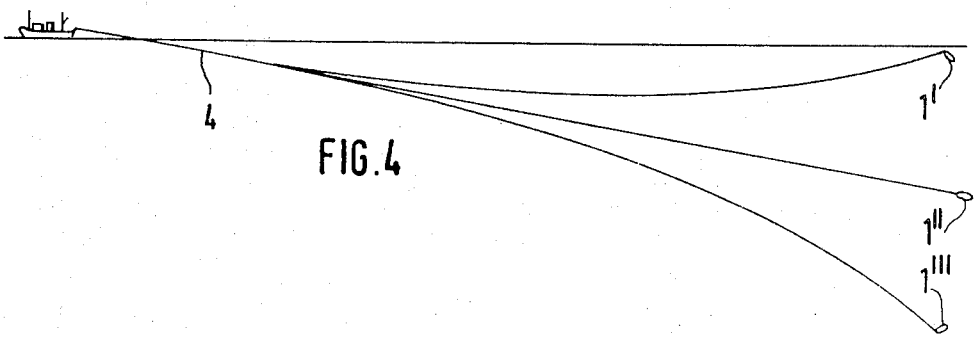
FIG. 4 shows the position of the towrope with different control depths of the drogue.

The probe cable 4 is attached right at the front to the towrope attachment 23 so that it can be freely deflected up and down. This is absolutely necessary for frictionless travel at different control depths 1', 1'', 1''', as may be understood from the sketch in FIG. 4. Also as already explained, only in combination with a free attachment of the rope can the self-stabilizing action of the transverse axis, as a result of the box-kite-shaped or rhombus lifting body, become effective in a logical way. Point attachments of that kind have hitherto been employed only seldom, since towropes are normally attached to kites by means of "balances" or stirrups or slings, that is, close to the dynamic centre of mass, which would lead, however, to the listing behavior described above and in the last analysis to forcible surfacing of the drogue, since the triangle formed from the two sides of the rope and the transverse axis acts practically as a rigid surface.

Figure 3:
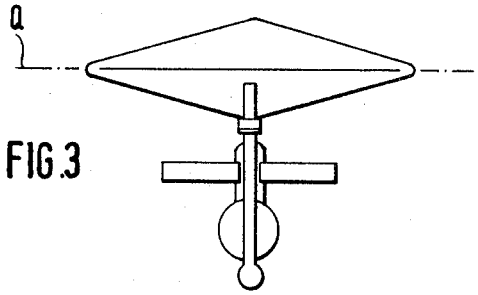
FIG. 3 is a front elevation of the towed body.

From the front elevation in FIG. 3 the relationship described above in the case of the transverse stabilization can easily be made clear, since it is readily recognized that upon tilting the transverse axis to the left the dynamic pressure on the right-hand surface becomes greater and a restoring moment thereby arises.

The regions at the side corners of the rhombus profile are if necessary rounded off in order to achieve reasonable flow conditions, but the crest line is made sharp in order to obtain a clear separation between the adjacent surfaces. By the concept "box-kite-shaped" is to be understood any shape by which the same or at least nearly the same transverse stabilization action can be achieved, whilst the towed body of essentially T-shaped cross-section behaves according to the known principle of centre-board or kite, but compared with a simple kite, because of the plate, with a selfcentreing of self-stabilizing effect.

What we claim is:

1. A remote controlled submersible drogue for carrying probes, for example for marine research, comprising:

attachment means for connecting a tow line of a towing craft at the tip of the front end of the drogue;

a lifting body being of a shape to generate dynamic lift when towed through water by a line connected to said attachment means;

means providing static stabilization of the drogue, including a flat plate attached to said lifting body and extending downwardly and rearwardly from said lifting body;

an adjustable elevator;

and said lifting body having a cross sectional rhombus shape as seen in a vertical plane perpendicular to the towing direction that in its stable position is a quadrangle consisting of two isosceles triangles with a common vertical base and is dynamically laterally stable by said shape constituting means for generating a restoring torque from the dynamic water pressure occurring during towing whenever the drogue is rotated from its stable position about an axis aligned with the towing direction.

2. The drogue according to claim 1, wherein said flat plate is split into a front, with respect to the towing direction, plate attached to the front end of said lifting body to extend as a whole downwardly and rearwardly, and a separate rearward plate secured to the rear end of said lifting body to extend as a whole downwardly and rearwardly;

a pressure resistant housing extending between said front and rearward plates beneath said lifting body;

remotely controllable power means for adjusting said elevator; and said elevator being spaced, with respect to the direction of towing, from said lifting body to provide maximum leverage with respect to said lifting body.

3. The drogue according to claim 1, including remotely controllable power means for adjusting said elevator; and said elevator being spaced, with respect to the direction of towing, from said lifting body to provide maximum leverage with respect to said lifting body, wherein said lifting body, as seen in plan view, is generally of a pear shape having its largest end to the front of the drogue and its smallest end to the rear of the drogue spaced forwardly of said elevator.

4. The drogue according to claim 1, further including a tow line having one end secured to said attachment means and its other end secured to a towing watercraft, and the length of said tow line being substantially five times the maximum operating depth of said drogue.

5. The drogue according to claim 1, including remotely controllable power means for adjusting said elevator; and said elevator being spaced, with respect to the direction of towing, from said lifting body to provide maximum leverage with respect to said lifting body.

6. The drogue according to claim 1 wherein said flat plate is split into a front, with respect to the towing direction, plate attached to the front end of said lifting body to extend as a whole downwardly and rearwardly, and a separate rearward plate secured to the rear end of said lifting body to extend as a whole downwardly and rearwardly;

a pressure resistant housing extending between said front and rearward plates beneath said lifting body, a rigid keel secured at its forward end to the lowermost portion of said front plate and having its rear end secured to the lowermost portion of said rear plate, said lifting body, housing, flat plate, and keel all being vertically aligned with respect to each other;

said attachment means being secured to said flat plate below said lifting body; and said power means for said elevator being to the rear of and aligned, with respect to the towing direction, with said housing.

7. The drogue according to claim 6, further including a tow line having one end secured to said attachment means and its other end secured to a towing watercraft, and the length of said tow line being substantially five times the maximum operating depth of said drogue;

remotely controllable power means for adjusting said elevator; and said elevator being spaced, with respect to the direction of towing, from said lifting body, to provide maximum leverage with respect to said lifting body, and wherein said lifting body, as seen in plan view, is generally of a pear shape having its largest end to the front of the drogue and its smallest end to the rear of the drogue spaced forwardly of said elevator.

* * * * *